US012312140B2

(12) United States Patent
Condon

(10) Patent No.: US 12,312,140 B2
(45) Date of Patent: May 27, 2025

(54) PACKAGE BACKER CARD WITH INTERLOCKING ARTICLE-RETAINING TABS

(71) Applicant: Plitek, L.L.C., Prospect Heights, IL (US)

(72) Inventor: Jeffrey R. Condon, Glenview, IL (US)

(73) Assignee: Plitek, L.L.C., Prospect Heights, IL (US)

( * ) Notice: Subject to any disclaimer, the term of this patent is extended or adjusted under 35 U.S.C. 154(b) by 24 days.

(21) Appl. No.: 18/541,490

(22) Filed: Dec. 15, 2023

(65) Prior Publication Data

US 2024/0262591 A1 Aug. 8, 2024

Related U.S. Application Data

(60) Provisional application No. 63/443,511, filed on Feb. 6, 2023.

(51) Int. Cl.
*B65D 73/00* (2006.01)

(52) U.S. Cl.
CPC ..... *B65D 73/0021* (2013.01)

(58) Field of Classification Search
CPC ..... B65D 73/0021; B65D 73/0014; B65D 73/005; B65D 85/04; A61B 17/06133; A61B 17/06114; A61B 50/20; A61M 25/002
USPC ..... 206/363, 364, 368, 438, 476–478, 206/480–482, 571, 572; 53/416, 492
See application file for complete search history.

(56) References Cited

U.S. PATENT DOCUMENTS 1,688,985 A * 10/1928 Person ..... G09F 5/042 206/476
4,023,678 A * 5/1977 Fiedler ..... A61F 6/14 206/476
5,131,537 A * 7/1992 Gonzalez ..... A61M 25/002 206/439
5,197,597 A * 3/1993 Leary ..... A61B 17/06133 206/483

(Continued)

OTHER PUBLICATIONS

Plitek Medical Packaging Cards, Plitek, L.L.C., Mt. Prospect, Illinois. <https://www.plitek.com/products/packaging-cards>, Date: Dec. 20, 2021. (3 pages).

(Continued)

*Primary Examiner* — Luan K Bui
(74) *Attorney, Agent, or Firm* — Jansson Munger & McKinley Ltd.

(57) ABSTRACT

A package backer card with interlocking article-retaining tabs for improved retention of an article for packaging. A package backer card may include an article-support panel and one pair, or more than one pair, of opposed tabs formed of the panel. The panel may be of a pliant material having a memory. Each of the opposed tabs may have a shank and an inwardly facing clip. Each tab may initially be in a position extending away from the other. Each tab may be bendable outward from the panel toward the other tab to a position in which the clips interlock together to form a restraint for an article therebetween. Each shank may be under tension to return toward the panel from the material memory to keep the clips interlocked to secure the article to the panel. Methods of securement of an article to a package backer card are disclosed.

11 Claims, 6 Drawing Sheets

(56) References Cited

U.S. PATENT DOCUMENTS

| | | | | |
|---|---|---|---|---|
| 5,390,063 | A | 2/1995 | Berg et al. | |
| 5,501,341 | A * | 3/1996 | Van Es | A61M 25/002 206/476 |
| 5,511,883 | A | 4/1996 | Clark et al. | |
| 5,535,764 | A | 7/1996 | Abramson | |
| 5,561,574 | A | 10/1996 | Engel et al. | |
| 9,522,251 | B2 * | 12/2016 | Katsuno | A61M 25/002 |
| 2010/0025273 | A1 * | 2/2010 | Matsuda | A61M 25/002 206/370 |
| 2020/0102133 | A1 * | 4/2020 | Bell | B65D 73/0021 |
| 2025/0040975 | A1 * | 2/2025 | Cremer | A61B 50/30 |

OTHER PUBLICATIONS

Benefits of Using a Backer Card for Your Sterile Barrier Packaging, Packaging Compliance Labs, LLC, Kentwood, MI. <https://pkgcompliance.com/benefits-of-using-a-backer-card-for-your-sterile-barrier-packaging>, Date: Sep. 18, 2020. (8 pages).

Hang Tabs Hook Roll 40 x 28 mm (1000 pcs RD250gr) HT349, E-xport.net, Istanbul, Turkey. <https://www.e-xport.net/product/hang-tabs-hook/>, Date: Copyright 2023. (4 pages).

* cited by examiner

PACKAGE BACKER CARD WITH INTERLOCKING ARTICLE-RETAINING TABS

RELATED APPLICATION

This application claims the benefit and filing date of U.S. Provisional Patent Application Ser. No. 63/443,511 filed with the United States Patent & Trademark Office on Feb. 6, 2023, the entire content of which is incorporated herein by reference for continuity.

FIELD

This invention relates generally to packaging, and more particularly, to package backer cards for retaining an article for packaging.

BACKGROUND

Many different types of articles are provided in packaging which includes what is referred to as a package backer card. A package backer card means or refers to a device which is used to securely hold one or more article in an organized and stable position. The package backer card and the article or articles secured thereon may be enclosed, for example, within a bag or pouch to provide a packaged unit in which the secured article or articles are enclosed. The bag or pouch and the package backer card are effective to both protect the article or articles from damage and to preserve cleanliness.

Package backer cards may be of a panel-type design and may be made of a thin plastic material such as high-density polyethylene (HDPE), polystyrene (PET), or like materials. The material may be manipulated to include any number and arrangement of retainers for securing the article or articles thereto. The retainers may be formed, for example, by die cutting the material. The retainers may be in form of clips, tabs, rails, teeth, rings, eyelets, walls, cutouts, valleys, and other shapes. The retainers may be configured, positioned, and arranged on the package backer card as needed to grip, surround, hold, and otherwise secure various parts or surfaces of the article or articles based on the unique geometry of each such article or articles.

Package backer cards are very useful to hold a wide range of articles. Package backer cards are particularly useful to hold articles with elongate and/or flexible parts. Just some examples of articles that are well suited for use with a package backer card are medical and surgical devices such as catheters, guidewires, medical tubing, surgical kits, and other devices. Non-medical articles with flexible components capable of being secured by a package backer card could be, for example, an electronic component with a wiring harness. Packaging of these types of articles using a package backer card is aided because the flexible parts can be secured in an organized manner. Separation of flexible parts by means of the retainers could aid in exposing surfaces for more effective sterilization or in subsequent assembly steps. Still other types of articles which may be packaged in a secure manner using a package backer card are medical devices and instruments such as a surgical suture device, a laparoscopic grasper, a clamp, and/or a trocar as well as many other articles of a non-medical nature.

While existing package backer cards are excellent for their intended purpose, there are opportunities for improvement.

One problem with certain package backer cards is that the retainers may apply insufficient force to adequately retain the article to the package backer card. For example, some clips, tabs, rails, and teeth may be excessively spaced from the article. In such embodiments, the retainer may not provide sufficient force to the article in both vertical and lateral vectors resulting in separation of the article from the package backer card. These retainers require precise tolerances to adequately hold the article, making design and manufacture of the package backer card more difficult.

A further problem is that certain retainers may be ineffective at releasing force applied to retain the article to the package backer card, making removal of the article from the card unduly difficult and complex. For example, retainers such as rings and eyelets may surround the article meaning that the retainer will not release the retaining force and that the article must be laterally inserted into, and removed from, that type of retainer.

It would be an improvement in the art to provide a package backer card which provides force necessary to limit lateral and vertical movement of an article such that the article is securely held on the package backer card, which would enable simplified removal of the force so that an article can be removed quickly and easily from the package backer card, and which would generally provide for improvement in the quality of packaging of a wide range of articles, including articles with complex structure.

SUMMARY

The present invention relates to improved package backer cards with interlocking article-retaining tabs. The improved package backer cards with interlocking tabs may be used to positively retain an article to the package backer card by providing lateral and vertical restraint to the article. The improved package backer cards with interlocking tabs may have sufficient tolerances to secure a wide range of articles without risk that the article will become unsecured. The improved package backer cards with interlocking tabs may quickly and simply release the retention so that the article may be easily removed from the package backer card.

In embodiments, a package backer card with interlocking article-retaining tabs according to the invention may include an article-support panel of a pliant material having a memory and one pair, or more than one pair, of opposed tabs formed of the panel. Each tab may have a shank and an inwardly-facing clip. Before securement of the article, each tab may initially be in a position extending away from the other tab. Each tab may be bendable outward from the panel toward the other tab to a position in which the clips interlock together to form a restraint for an article between the tabs. After the interlocking, each shank is under tension to return toward the panel from the material memory to maintain the interconnection.

In embodiments, the shanks and clips have inward edges. The shank inward edges may be spaced apart to provide lateral restraint for an article therebetween. The clip inward edges may be spaced apart from the panel to provide a vertical restraint for the article therebetween. The vertical and lateral restraint retains the article on the package backer card.

In certain embodiments, the panel may be a single sheet of material and the tabs may be defined by a gap formed from the panel. The tabs and gap may be formed, for example, by die cutting the panel material.

Each clip of the tabs may have an interlocking surface and the interlocking surfaces may be held in contact by the material memory. The panel may have a first side for supporting the article and an opposite second side and the interlocking surfaces may be from the second side of the panel. A hinge may be formed at a junction of each shank and the panel. In embodiments, the hinges may be along a common axis.

Panels suitable for use herein may have a thickness dimension between the first and second sides of between about 5 mils and about 50 mils. A variety of materials may be utilized to make the panel. Examples are high-density polyethylene (HDPE), polystyrene (PET), Linear low-density polyethylene (LLDPE), polypropylene (PP), polyethylene terephthalate (PET), and high impact polystyrene (HIPS).

Package backer cards with interlocking article-retaining tabs may be used to implement a method of securing an article to package backer card. An example of a method may include a first step of placing an article proximate an article support panel of a pliant material with properties of memory. In a further step, there may be placing of the article between a pair of opposed tabs formed of the panel. Each tab may have a shank and an inwardly-facing clip and each tab may extend outward from the panel in a direction opposite from the other tab. Each tab may be bendable toward the other to a position in which the clips interlock together to form a restraint for an article with each shank under tension to return to the first position by the material memory. In a further step, there may be bending of the tabs toward the other against the memory to interlock the clips to thereby surround the article and provide lateral and vertical restraint to the article to thereby secure the article to the package backer card.

Other features and embodiments are described in the drawings and detailed description which follows.

BRIEF DESCRIPTION OF THE DRAWINGS

Examples of a package backer card with interlocking article-retaining tabs provided therein may be understood by reference to the following description taken in conjunction with the accompanying drawings, in which like reference numerals identify like elements throughout the different views. The drawings are not necessarily to scale, emphasis instead being placed upon illustrating the principles of the invention.

In the accompanying drawings.

DETAILED DESCRIPTION

Figure 3:
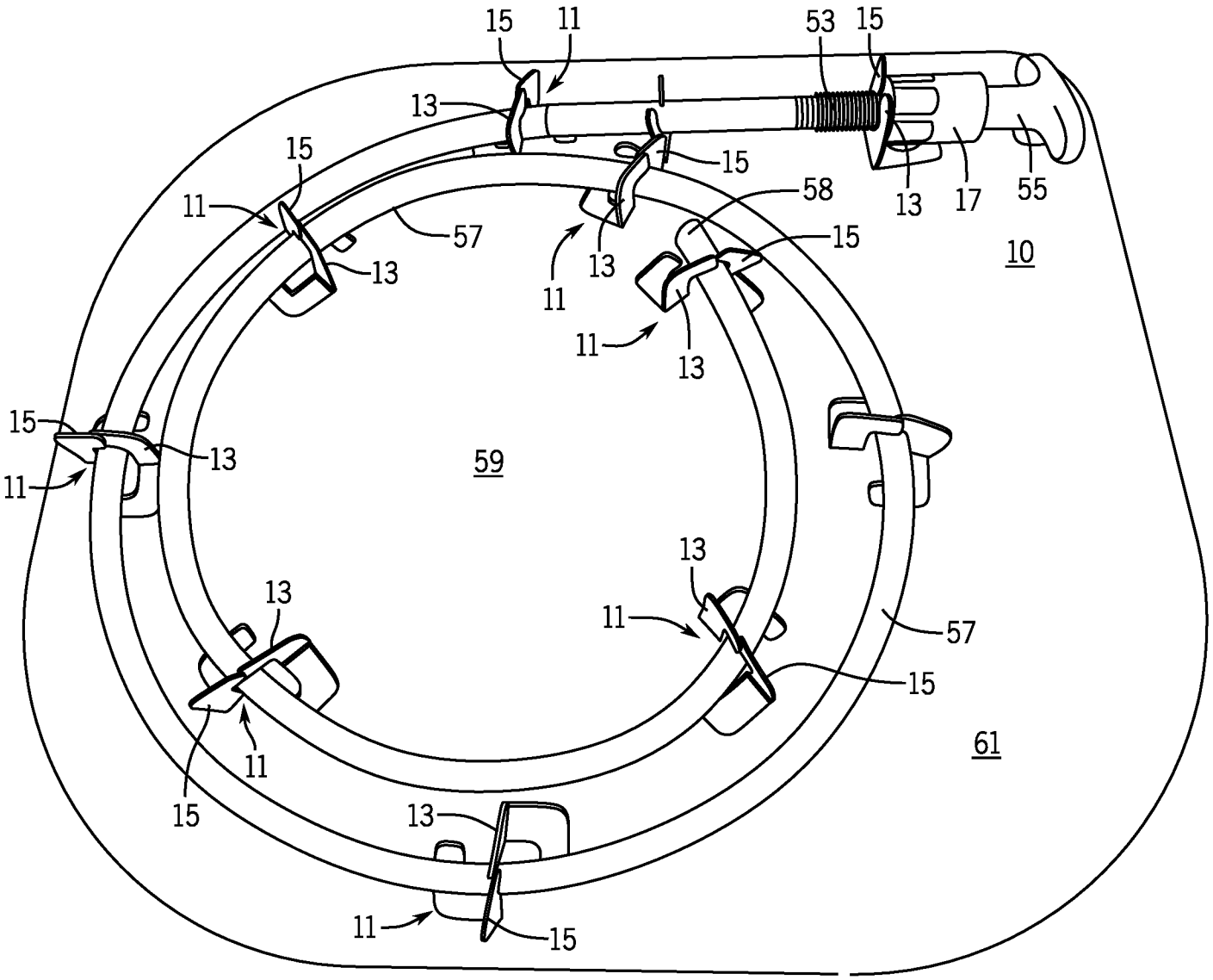
FIG. 3 is a perspective view of a package backer card according to the invention together with an article in the form of a medical device secured thereto.
Figure 4:
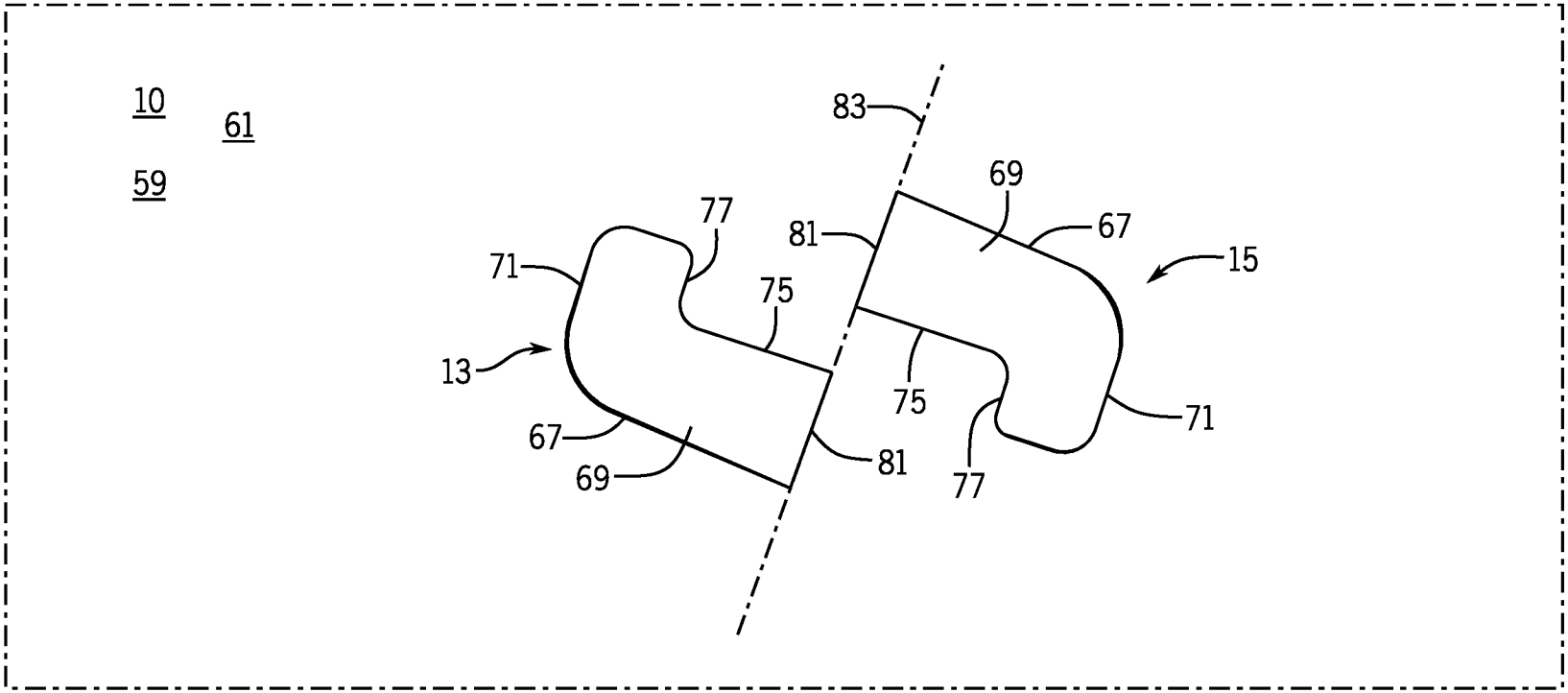
FIG. 4 illustrates a pair of interlocking article-retaining tabs of the type illustrated in FIG. 3 formed in a package backer card.
Figure 5:
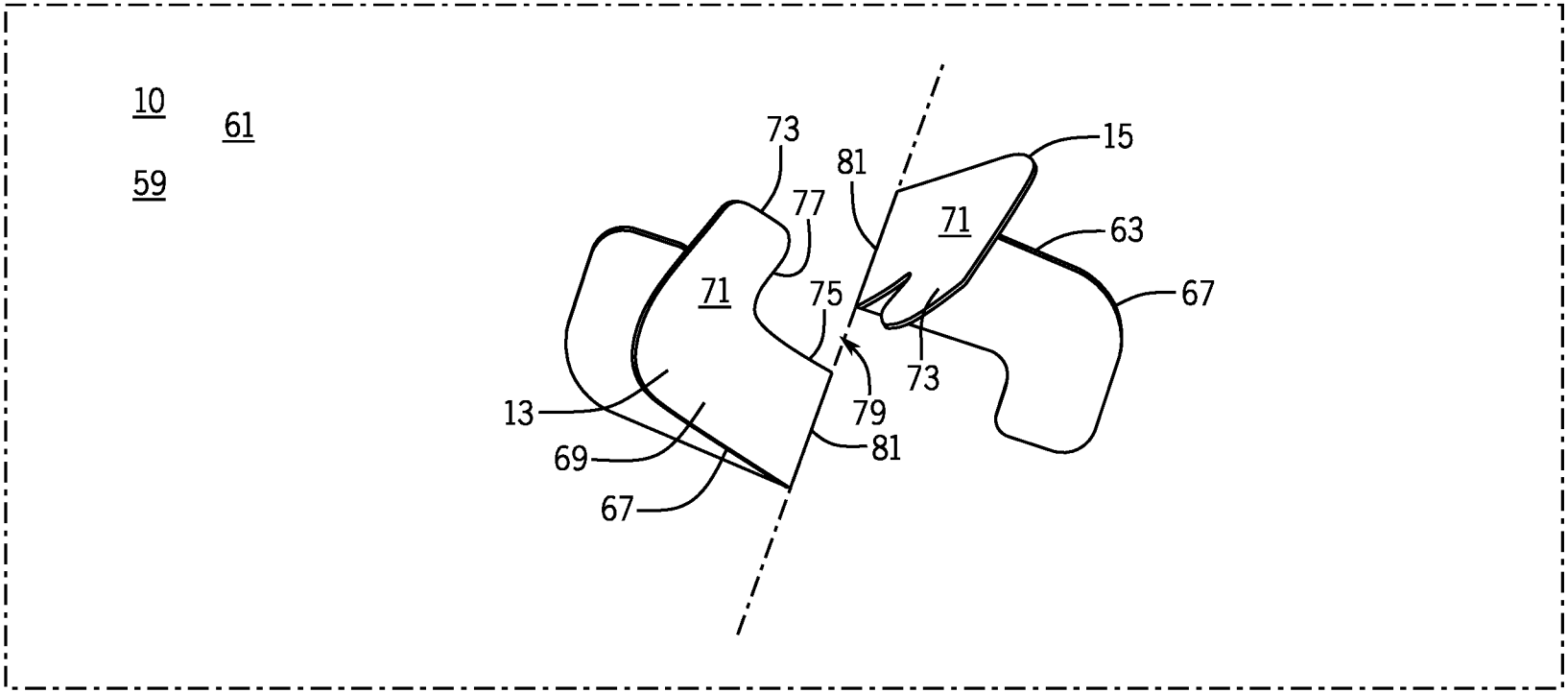
FIG. 5 illustrates the interlocking article-retaining tabs of FIG. 4 extending away from the package backer card.
Figure 6:
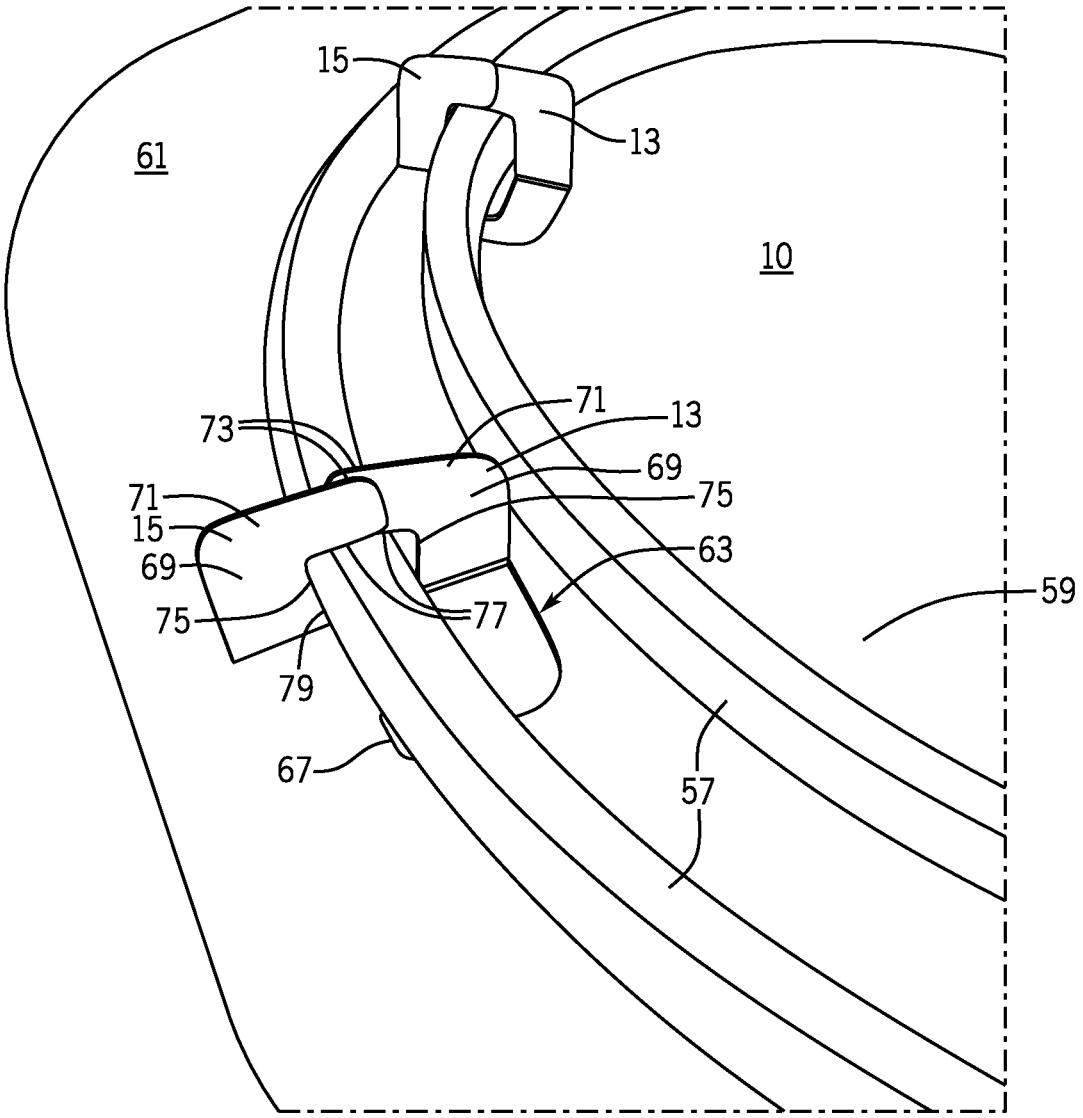
FIG. 6 illustrates the interlocking article-retaining tabs of FIGS. 3-5 in an interlocked state providing retention of the medical device to the package backer card.

Referring to FIGS. 3-6, the present invention relates to improvements in package backer cards, an example of which is package backer card 10 with one or more retainer 11 in the form of novel interlocking article-retaining tabs illustrated by the examples of tabs 13, 15. In the embodiments, interlocking article-retaining tabs 13, 15 are capable of providing both lateral and vertical retention securing an article 17 or articles to the package backer card 10 as illustrated in FIGS. 3 and 6. Interlocking article-retaining tabs 13, 15 further provide for improved release of article 17 when it becomes necessary to detach article 17 from the package backer card 10, for example, prior to use of the article 17. The invention further relates to novel methods of securing articles 17 to package backer cards 10, made possible by interlocking tabs 13, 15. In order to better understand the improvements in packaging made possible by package backer card 10, it is useful to first briefly review the prior art.

Figure 1:
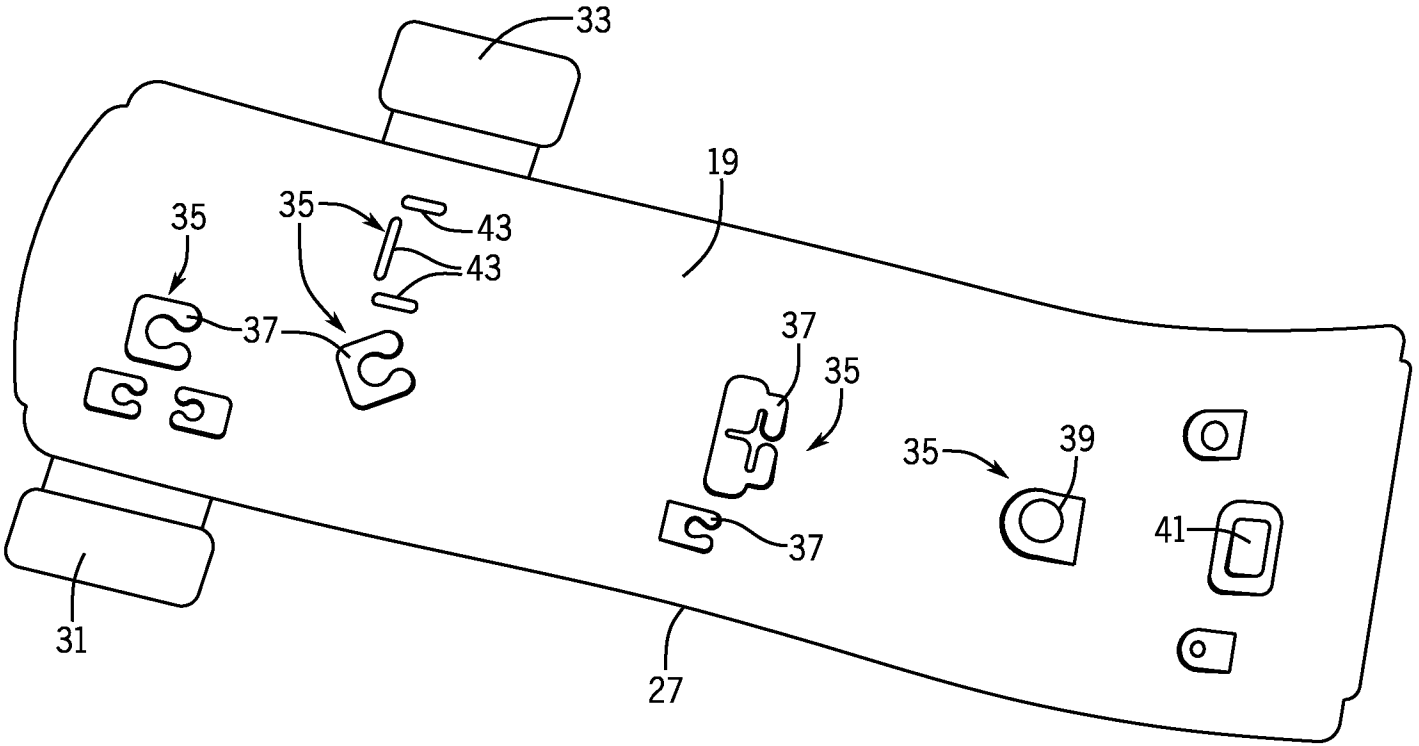
FIG. 1 PRIOR ART
FIGS. 1-2 illustrate representative package backer cards according to the prior art.
Figure 2:
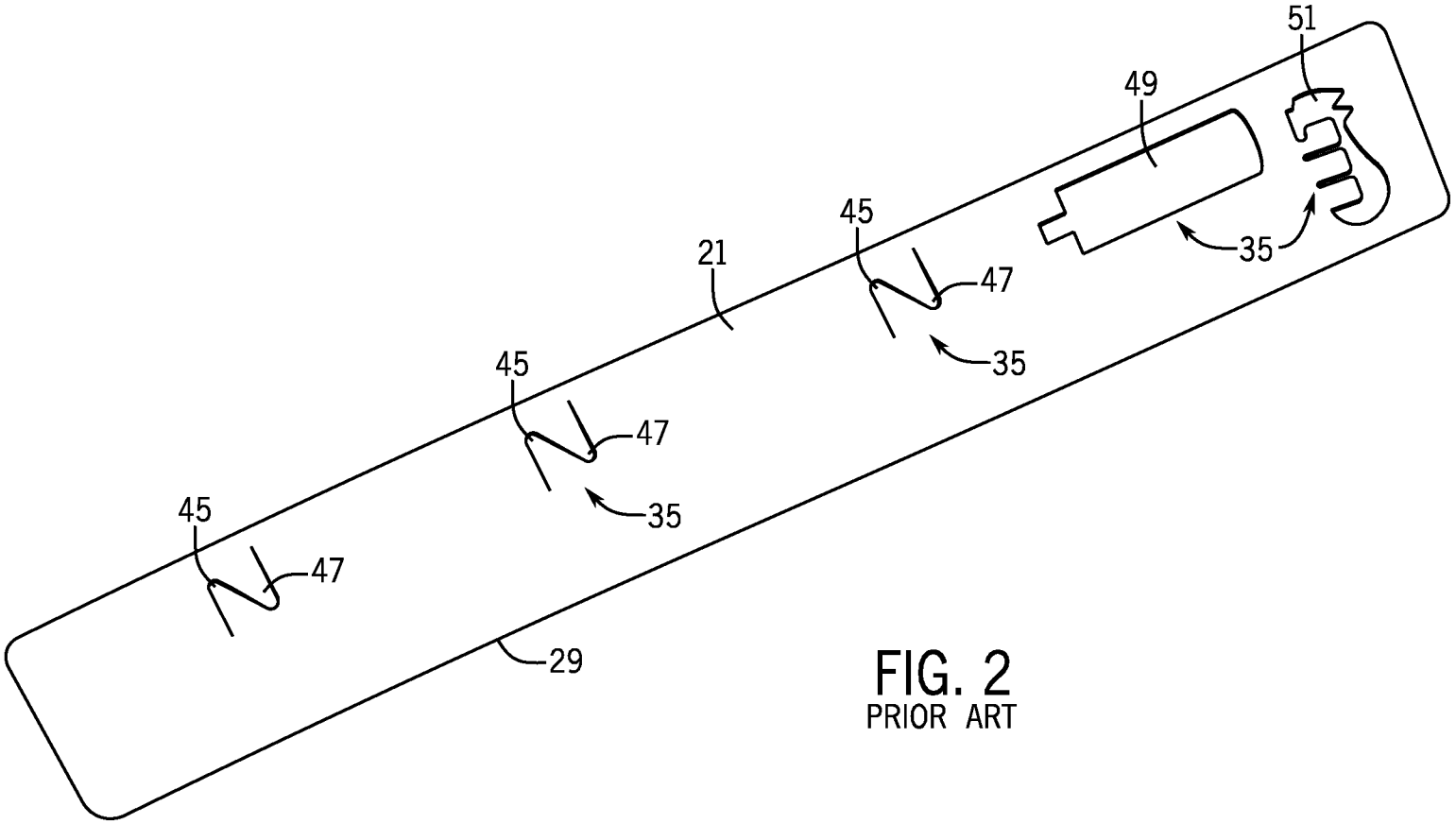
FIG. 2 PRIOR ART

Referring to FIGS. 1 and 2, those figures show examples of two package backer cards 19, 21 of the prior art. Package backer cards 19, 21 are excellent for their intended purpose, which is to secure an article (e.g., FIGS. 3, 6 article 17) or articles thereto. The package backer card 19, 21 and article(s) secured thereto may subsequently be enclosed by a bag or pouch (not shown) to provide a sealed package.

Each of package backer cards 19, 21 shown in FIGS. 1-2 may comprise a panel 27, 29 of sheet-like material. Panels 27, 29 shown in FIGS. 1-2 may comprise a sheet of HDPE with a nominal thickness dimension of about 30 mils. Each panel 27, 29 may include a configuration customized for attachment of the article or articles to be secured thereto. For instance, panel 27 of FIG. 1 is shown with a pair of lateral flaps 31, 33 for securing panel 27 to another packaging structure, whereas panel 29 of FIG. 2 lacks flaps.

Each of panels 27, 29 includes numerous retainers collectively indicated by reference number 35, which have a structure and operation unlike that of the novel interlocking article-retaining tabs 13, 15. Retainers 35 of panels 27, 29 may be formed by use of a die cutting process. The die cutting process can completely remove material from the panel 27, 29 and can form shapes in the panel material designed to contact mating surfaces of the article to be secured on panel 27, 29. Referring to FIG. 1, panel 27 is shown with a plurality of die cut clips (each indicated by reference number 37), a ring 39, a rail 41, and an opening 43. Referring to FIG. 2, panel 29 is shown with a plurality of facing teeth (each indicated by reference numbers 45, 47) and openings 49, 51.

Panels 27, 29 must be configured and arranged to fit the unique shape of the article to be secured thereto. Should clips 37, rail 41, and openings 43, 49, 51 lack the required tight tolerances and needed retaining force, then the article could become detached from panel 27, 29. A retainer 35 in the form of a ring 39 cannot provide for any quick release of the article. Instead, the article must slide laterally out and away from such a ring 39 or the ring 39 must be opened such as by cutting and these types of actions may be inconvenient for the person seeking to remove the article from the package backer card 29, particularly if the article is elongate or includes flexible wires or tubing.

Turning then to FIGS. 3-6, exemplary package backer card 10 with novel interlocking article-retaining tabs 13, 15 solves the above-mentioned problems, thereby providing a further opportunity for packaging of a wide range of articles by means of an improved package backer card 10. As illustrated in FIGS. 3 and 6, the example of package backer card 10 illustrated therein is shown holding an article 17 in the form of a medical device 53. Medical device 53 incudes a control unit 55 and an elongate flexible tube 57 which terminates in a distal end 58. As is apparent, flexible tube 57 must be held on the package backer card 10 in a secure and neatly organized manner. Retainers 11 provide the needed retention and organization of the flexible tube 57 in particular as is well illustrated in FIG. 3. Interlocking tabs 13, 15 provide an improved means by which to secure and, alternatively, to detach medical device 53 and flexible tube 57 with respect to package backer card 10 as described herein. Ten pairs of interlocking tabs 13, 15 are shown in FIG. 3, although any number and arrangement of interlocking tab 13, 15 pairs may be implemented.

Referring again to FIGS. 3-6, package backer card 10 may comprise an article-support panel 59 of sheet-like material. Panel 59 may be of any pliant material providing physical properties (e.g., rigidity, torsional strength, etc.) sufficient for securement of article 17 to package backer card 10. The material used for panel 59 should have the property of "memory" which, as the material seeks to return to its original position, is useful to apply a force urging tabs 13, 15 into interlocking contact. The force applied by the memory is also useful to hold those tabs 13, 15 in interlocking contact until the contact between tabs 13, 15 is released by a human when removing article 17 from package backer card 10 as described in further detail below. Examples of materials with memory capable of use for panel 59 may include high-density polyethylene (HDPE), polystyrene (PET), Linear low-density polyethylene (LLDPE), polypropylene (PP), polyethylene terephthalate (PET), and high impact polystyrene (HIPS), or the like.

In embodiments such as illustrated in FIGS. 3-6, panel 59 may be a single sheet of material. Panel 59 may be planar, that is panel 59 may generally lie in a plane. Panel 59 of package backer card 10 may have a first side 61 and an opposite second side 63. An article 17 may be supported along panel 59 first side 61, although an article 17 could also be supported on second side 63, and on both first and second sides 61, 63 depending on the application. Panel 59 need not fall entirely in a plane. For example, panel 59 might be of a stepped configuration or might have side or end walls protruding above or below panel 59 in, for example, a relationship normal to panel 59.

The material implemented for package backer card 10 may have a nominal thickness dimension in the range of from about 5 mils to about 50 mils between first and second sides 61, 63. The thickness and physical properties (e.g., rigidity) of the material may have an effect on the force applied by tabs 13, 15 against one another and which interlocks the tabs 13, 15. Therefore, the thickness and material properties of panel 59 from which tabs 13, 15 are a part may be selected to tailor the force applied by tabs 13, 15 against one another to provide the desired securement of article 17.

Panel 10 shown in FIGS. 3-5 may be of any suitable shape and size. Examples of shapes can include squares, rectangles, circles, and polygons to name a few.

In the examples of FIGS. 3-6, panel 59 may include one or more retainer 11 in the form of pairs of interlocking tabs 13, 15. Package backer card 10 of FIG. 3 illustrates ten pairs of tabs 13, 15. Tabs 13, 15 may be formed of the panel 59 material and may be defined by a gap 67 (i.e., a space) formed from panel 59. In embodiments, gap 67 and the shape of tabs 13, 15 may be formed by die cutting of panel 59. In other embodiments, tabs 13, 15 and gap 67 defining tabs 13, 15 may be formed by techniques such as laser ablating and waterjet cutting.

Referring to FIGS. 4-6, each tab 13, 15 may include a shank 69 and an inwardly facing clip 71. Clip 71 of each tab 13, 15 extends toward the other sufficiently to provide overlap of the clips 71 for interlocking securement of tabs 13, 15. Interlocking of tabs 13, 15 occurs by contact between overlapping clips 71 along a facing and overlapping interlocking surface 73 of each clip 13, 15 which constrains movement of tabs 13, 15 back toward panel 59 under the influence of the material memory. Each interlocking surface 73 may be from second side 63 of panel 59.

Each clip 65 may extend from its respective shank 69 at approximately a right angle as illustrated in FIG. 4 to provide a generalized "J" shape. It is to be understood that configurations of tabs 13, 15 other than those shown in FIG. 4 may be implemented.

Shank 69 and clip 71 of each tab 13, 15 may each include inward edges 75, 77 for purposes of providing lateral and vertical restraint to an article 17, such as the flexible tube 57 of medical device 53 between edges 75, 77. In the embodiments, inward edge 75 of each shank 69 of tab pair 13, 15 may be spaced from one another to provide lateral restraint for article 17 between edges 75. Further, inward edge 77 of each clip 71 of tab pair 13, 15 may be spaced from panel 59 first side 61 to provide a vertical restraint for an article 17 between clip inward edges 77 and panel 59. Inward edges 75, 77 in effect define an opening 79 within which article 17 may be positioned when secured to package backer card 10.

Each tab 13, 15 may initially be in a position extending away from the other tab 13 or 15 in an opposed relationship such as that illustrated in FIG. 4. Each tab 13, 15 may be bendable outward from panel 59 and toward the other tab 13 or 15 to a position in which clips 71 and surfaces 73 interlock together to form a restraint for an article 17 between tabs 13, 15 and panel 59 first side 61. Because of the material memory of panel 59, each shank 69 may be under tension to return to its original position toward panel 59 and in the plane of panel 59. Such tension is applied to each tab 13, 15 in a direction opposite the other tab 13 or 15 and such tension keeps contact surfaces 73 of respective tabs 13, 15 in the interlocking contact relationship.

In effect, a hinge 81 forms at the junction of each shank 69 and panel 59 as illustrated in FIG. 5. It has been found that arrangement of tabs 13, 15 of each tab pair with each hinge 81 along a common or single axis 83 produces balanced opposing forces which keep tabs 13, 15 firmly in interlocking contact providing an excellent restraint 11 holding article 17 to package backer card 10. The simple connection of tabs 13, 15 provides a sort of "quick connect" mechanism allowing rapid and secure attachment of article 17 to package backer card 10 by a human. This quick connect capability can be particularly desirable when seeking to secure a flexible tube or flexible part to package backer card 10.

Tabs 13, 15 may be easily detached from each other to remove the restraint holding article. Detachment of tabs 13, 15 may be accomplished simply by bending clips 71 and tabs 13, 15 away from the other using one's fingers. This arrangement provides a sort of "quick release" mechanism allowing a human user to quickly and conveniently remove all restraint holding article 17 in place on package backer card 10. This quick release capability is not possible with ring type restraints such as rings 39 and 65.

Package backer card 10 may be used in a manner such as described above and below. The description which follows describes both an apparatus and an improved method of securing an article to a package backer card with interlocking article-retaining tabs.

Prior to use with an article 17, a designer or manufacturer can first determine the design of package backer card 10 implementing a panel 59 shape, size, material, and retainer 11 placement optimally selected based on the structure of article 17 to be packaged and secured to package backer card 10. For example, an article with flexible components such as tubing 57 or wiring might require a relatively greater amount of retainers 11 in the form of tabs 13, 15 in order to neatly secure article 17 to the package backer card 10. In embodiments, a die for a press can then be designed to form package backer card 10 and tabs 13, 15 from material stock using a press.

At a point of packaging for article 17, a user can first place an article 17 proximate panel 59 with parts of article 17 to be restrained next to the appropriate pair of tabs 13, 15 as illustrated, for example, by FIGS. 3 and 6. Next, the portion of article 17 to be restrained may be placed between a pair of opposed tabs 13, 15. As illustrated in FIGS. 5-6, the user may push and bend each tab 13, 15 from an initial position in which each tab 13, 15 extends away from the other toward a further position in which the tabs 13, 15 are urged toward the other against the memory of the material to a position in which clips 71 of the respective tabs interlock together behind the other clip 71 with interlocking surfaces 73 at least partially in contact with the other to form a restraint 11 for the article 17 between the tabs 13, 15 and panel 59. Interlocking clips 71 are held in contact with each other because each shank 69 is under tension to return toward panel 59 because of the memory provided by the panel 59 material. Interlocking of clips 71 captures article 17 on package backer card 10 between inner edges 75, 77 and panel 59 providing lateral and vertical restraint for article 17. Tabs 13, 15 provide for improved retention of article 17 as compared with clips 37, teeth 45, 47, and rails 41 of the prior art because the tolerances of tabs 13, 15 can be less precise than for the clips 37, teeth 45, 47, and rails 41 thereby avoiding unwanted detachment of article 17 from package backer card 10.

The foregoing process is repeated for each pair of tabs 13, 15 resulting in attachment of article 17 to package backer card 10 as illustrated, for example, in FIG. 3. Package backer card 10 and article 17 may then be loaded in an appropriate bag or pouch with appropriate article 17 identification indicia added to complete the packaging process.

To remove article 17 from its package, the process described above is simply reversed. After removing package backer card 10 and article 17 from any bag or pouch, the user can simply disconnect clips 71 of each tab 13, 15 with his or her fingers to release article 17 from tabs 13, 15. Article 17 may then be used and package backer card 10 and any bag or pouch may be recycled or discarded.

The novel package backer card 10, therefore provides for a type of "quick connect" of each retainer 11 to article 17 and for a type of "quick release" of each retainer 11 from article 17, thereby decreasing the time and effort required to attach and detach article 17 to and from package backer card 10 as compared with prior art package backer cards 19, 21. These advantages are achieved while ensuring positive restraint of article 17 on package backer card 10 between shank 69 and clip 71 inner edges 75, 77 and panel 59 within opening 79 defined by edges 75, 77. Further, the novel package backer card 10 avoids any necessity for ring type retainers 39, making it easier and quicker for a user to attach and detach article 17 to and from package backer card 10.

The foregoing description is provided for the purpose of explanation and is not to be construed as limiting the invention. While the invention has been described with reference to preferred embodiments or preferred methods, it is to be understood that the words which have been used herein are words of description and illustration, rather than words of limitation. Section headings are non-limiting and are provided for the reader's convenience only. Furthermore, although the invention has been described herein with reference to particular structure, methods, and embodiments, the invention is not intended to be limited to the particulars disclosed herein, as the invention extends to all structures, methods and uses that are within the scope of the appended claims. The disclosed package backer card with interlocking article-retaining tabs may address some or all of the problems previously described.

A particular embodiment need not address all of the problems described, and the claimed pressure interlocking article-retaining tabs should not be limited to embodiments comprising solutions to all of these problems. Further, several advantages have been described that flow from the structure and methods; the present invention is not limited to structure and methods that encompass any or all of these advantages. Those skilled in the relevant art, having the benefit of the teachings of this specification, may effect numerous modifications to the invention as described herein, and changes can be made without departing from the scope and spirit of the invention as defined by the appended claims. Furthermore, any features of one described embodiment can be applicable to the other embodiments described herein.

What is claimed is:

1. A package backer card with interlocking article-retaining tabs comprising:

an article-support panel of a pliant material having a memory; and a pair of opposed tabs formed of the panel, each tab having a shank and an inwardly-facing clip, each tab initially being in a position extending away from the other and being bendable outward from the panel toward the other tab to a position in which the clips interlock together to form a restraint for an article therebetween with each shank under tension to return toward the panel from the material memory.

2. The package backer card of claim 1 wherein the shanks and clips have inward edges and the shank inward edges are spaced apart to provide lateral restraint for an article therebetween and the clip inward edges are spaced apart from the panel to provide a vertical restraint for the article therebetween.

3. The package backer card of claim 2 wherein the panel is a single sheet of material and the tabs are defined by a gap formed from the panel.

4. The package backer card of claim 3 wherein the tabs are die cut from the panel.

5. The package backer card of claim 4 wherein the tabs have a generalized "J" shape.

6. The package backer card of claim 3 wherein each clip has an interlocking surface and the interlocking surfaces are held in contact by the material memory.

7. The package backer card of claim 6 wherein the panel has a first side for supporting the article and an opposite second side, and the interlocking surfaces are of the second side of the panel.

8. The package backer card of claim 7 wherein a hinge is formed at a junction of each shank and the panel and the hinges are along a common axis.

9. The package backer card of claim 7 wherein the panel has a thickness dimension between the first and second sides of between about 5 mils and about 50 mils.

10. The package backer card of claim 9 wherein the panel material is selected from the group consisting of high-density polyethylene (HDPE), polystyrene (PET), Linear low-density polyethylene (LLDPE), polypropylene (PP), polyethylene terephthalate (PET), and high impact polystyrene (HIPS).

11. A method of securing an article to package backer card with interlocking article-retaining tabs comprising:

placing an article proximate an article support panel of a pliant material with properties of memory;

placing the article between a pair of opposed tabs formed of the panel, each tab having a shank and an inwardly-facing clip, each tab extending outward from the panel in a first direction opposite from the other tab and being bendable toward the other to a position in which the clips interlock together to form a restraint for an article with each shank under tension to return to the first position by the material memory; and bending the tabs toward the other against the memory to interlock the clips to thereby surround the article and provide lateral and vertical restraint to the article to thereby secure the article to the package backer card.

* * * * *